United States Patent [19]

Kageyama et al.

[11] Patent Number: 4,895,467

[45] Date of Patent: Jan. 23, 1990

[54] ROTARY KNOCK TYPE MECHANICAL PENCIL

[75] Inventors: Hidehei Kageyama, Saitama, Japan; Robert V. Lozeau, Cumberland, R.I.

[73] Assignees: Kotobuki & Co., Ltd., Kawagoye, Japan; A. T. Cross Company, Lincoln, R.I.

[21] Appl. No.: 123,266

[22] Filed: Nov. 20, 1987

[30] Foreign Application Priority Data

Nov. 25, 1986 [JP] Japan ..... 61-180740
Jun. 15, 1987 [JP] Japan ..... 62-91654

[51] Int. Cl.[4] ..... B43K 21/20

[52] U.S. Cl. ..... 401/65; 401/67; 401/79

[58] Field of Search ..... 401/65, 67, 79

[56] References Cited

U.S. PATENT DOCUMENTS

| | | | |
|---|---|---|---|
| 2,166,751 | 7/1939 | Cooper | 401/65 |
| 4,172,673 | 10/1979 | Puchein . | |
| 4,218,153 | 8/1980 | Hashimoto . | |
| 4,227,822 | 10/1980 | Kokubu | 401/65 |
| 4,362,410 | 12/1982 | Hashimoto | 401/67 |
| 4,619,539 | 10/1986 | Kageyama | 401/65 |
| 4,620,811 | 11/1986 | Kageyama | 401/65 |

FOREIGN PATENT DOCUMENTS

| | | | |
|---|---|---|---|
| 480717 | 2/1938 | United Kingdom | 401/67 |
| 1581410 | 12/1980 | United Kingdom | 401/65 |

*Primary Examiner*—Richard J. Apley
*Assistant Examiner*—Franklin L. Gubernick
*Attorney, Agent, or Firm*—Colucci & Umans

[57] ABSTRACT

A rotary knock type mechanical pencil in which the forward and rearward outer cylinders are relatively rotated, a cam movement converting mechanism stored in the forward outer cylinder converts the rotary movement into an axial advancing or retracting movement, the lead feeding mechanism may feed the lead of desired length from the extremity end of the mechanical pencil under a knocking operation in the shaft comprising: a cam cylinder integrally rotating with the rearward outer cylinder that includes two cam surfaces and an engaging part which allows retraction of a lead guide pipe; a rotary cam mechanism for converting the rotary movement of the cam cylinder into a reciprocating advancing or retracting movement while slidably contacting with the cam surface formed at the extremity end surface of the cam cylinder; a lead feeding mechanism including an advancing or retracting mechanism such as a cassette adapter for advancing or retracting the lead chuck attached to the extremity end under a reciprocating movement applied through the rotary cam mechanism, a lead chuck for holding the lead, and a tightening member freely inserted into the extremity end of the lead chuck and for holding or releasing a lead of the lead chuck as its advancing movement is carried out.

8 Claims, 14 Drawing Sheets

18
28
70
29
1a
160
1
100b
180i
13
100
11
50
X
X
9
7
8
180j
10
16A
4b
S
4
4a
3
170
110a
30
100a
110
29a
29
S
13
100
110
9
50

27
1b
180
18

ROTARY KNOCK TYPE MECHANICAL PENCIL

BACKGROUND OF THE INVENTION

1. Field of the Invention

This invention relates to a rotary knock type mechanical pencil in which a lead feeding mechanism arranged in an outer cylindrical body including a forward outer cylinder and a rearward outer cylinder is operated to feed out a lead under a knock action by a relative rotation of these outer cylinders, and more particularly, a rotary knock type mechanical pencil in which the lead feeding mechanism within the body can perform a smooth and positive lead feeding operation under a relative rotation of the forward and rearward outer cylinders.

2. Description of the Prior Art

In recent years, various types of knock type mechanical pencils provided with some superior mechanisms such as an automatic lead feeding mechanism, an extremity end knock mechanism or the like have been proposed in the mechanical pencil field. These knock type mechanical pencils have, on the one hand, proved dependable for consumers due to ease and positiveness in operation and on the other hand, have some disadvantages in that the design spoils the outer aesthetic appearance due to the need to arrange a knock operating part either at an upper end of the body or at an outer circumferential side of the body. In view of this fact, there has been proposed a rotary slide type of rotary knock type mechanical pencil having both a better outer appearance and functional superiority.

The conventional type of the above-mentioned rotary knock type mechanical pencil is composed of a forward outer cylinder provided with a lead feeding mechanism at its inner extremity end side and a rearward outer cylinder having a cam cylinder therein which are rotatably connected to each other. This rotary knock type mechanical pencil is operated such that a writer holds one outer cylinder and the other outer cylinder is rotated in any direction, thereby the cam cylinder is rotated in a circumferential direction by a specified range, and the cam surface of the cam cylinder reciprocates an extended rod of the lead feeding mechanism abutting against the cam surface, resulting in generating a so-called cam movement. An operating force in a reciprocating direction converted from the cam movement may perform the knock operation of the lead feeding mechanism, resulting in that the lead is fed out of an extremity end of the mechanical pencil under the knock action.

Examples of the conventional type of rotary knock type mechanical pencil described above, are disclosed U.S. Pat. No. 4,269,524 and U.S. Pat. No. 4,362,410. These patents disclose that each of the forward and rearward outer cylinders is connected to each other in such a way as they may be rotated relative to each other. As shown in U.S. Pat. No. 4,269,524, a lead feeding mechanism is provided for feeding lead responsive to the operation of a rotary cylinder 124, within the outer cylinder, which acts a a cam cylinder having a slant surface 132 which is abutted against an extending rod 13 of the feeding mechanism which is formed with a cam surface at its extremity end side to convert the rotary movement into a reciprocating movement.

However, according to the rotary knock type mechanical pencil described in the above-mentioned U.S. Pat. No. 4,269,524, a lead feeding mechanism such as a tightening member receiver 113, a tightening member 11 and a chuck 19 or the like is integrally formed with a lead case 20 at the rear end of the chuck, and in case of performing a lead feeding operation, so-called knock operation, all the component elements positioned at the inner central side of the mechanical pencil perform a reciprocating movement. Since the lead case 20 is set at its position by only a spring $S_1$ within the rotary cylinder 124, a looseness is generated at the lead feeding mechanism within the mechanical pencil during the reciprocating movement and so a positive lead feeding operation can not be performed.

Secondly, the rotary cylinder 124 directly advances or retracts the tightening member receiver 113 through the extend rod 13 via its slant surface 132. Since this tightening receiver 113 advances or retracts to cause the tightening member 11 to fasten the chuck 19 or to release the fastening operation, a lead feeding operation of the tightening member 11 while being released from the chuck 19 is merely performed by chance, and a lead feeding operation with the rotary knock type mechanical pencil having this mechanism can be performed only in the case that the lead L drops together with the lead retainer 18 downwardly via extremity end of the mechanical pencil and so it has a problem that a positive lead feeding operation can not be performed.

Thirdly, although the mechanical pencil of U.S. Pat. No. 4,269,524 has an advance of requiring a fewer number of component elements, it has another problem that irrespective of the constitution having less number of parts, for example, it is necessary to form a guide groove 10, a projection 12, a receiving member 120 and a projection 121 or the like so as to guide a reciprocating movement of the lead feeding mechanism, resulting in a complex structure.

Fourthly, according to the patent, since a lead L is set for its position while the rotary cylinder 124 is rotated and the chuck 19 is fastened with the tightening member receiver 113 and the tightening member 11 so as to perform a writing operation, it shows a problem that in case of a quite strong writing pressure of the writer, this strong writing pressure can not be dampened, the lead is frequently broken and under the worst condition the lead feeding mechanism or rotary mechanism is detrimentally affected.

SUMMARY OF THE INVENTION

This invention is provided to resolve the above-mentioned problems and accomplish the following objects.

It is the first object of the present invention to provide a rotary knock type mechanical pencil in which a lead feeding mechanism for feeding the lead from an extremity end of the mechanical pencil by a desired amount and a lead case strong leads and supplying a lead when a lead is not present in the lead feeding mechanism are separately made, thereby no looseness is generated in the inner mechanism when the lead feeding mechanism advances or retracts under a relative rotary operation of the outer cylinder to feed the lead and a positive lead feeding operation can be performed.

It is the second object of the present invention to provide a rotary knock type mechanical pencil in which a tightening member receiver for fastening or releasing a chuck against or from the tightening member is not directly advanced or retracted, but a cam engaging means, slid along a cam surface formed at a rotary cylinder to perform an advancement or retracting movement, and a chuck are integrally formed to each other, a sleeve acting as a tightening member for fastening or releasing of chuck is separately arranged and at the same time each of a springs is arranged between the sleeve and an inner circumferential surface of the fixed shaft and between the sleeve and a movable cam engaging means, and a positive lead feeding operation can be performed under the actions of these springs not only in the case that the rotary knocking operation is carried out in a downward direction, but also in the case that for example the rotary knocking operation is carried out in upward direction.

It is the third object of the present invention to provide a rotary knock type mechanical pencil in which a superior assembling operation of an inner mechanism can be made, its manufacturing cost can be reduced to a less expensive value and it has less trouble during its secular use by a method wherein an arrangement of the component parts within the shaft and various mechanisms constituted by these component parts are simplified irrespective of much or less amounts of component parts.

It is the fourth object of the present invention to provide a rotary knock type mechanical pencil preventing a breakage of lead and improving a writing touch in which as described in the second object, each of the springs is arranged between a sleeve acting as a chuck tightening member and a fixed part and between the sleeve and the movable part, respectively, and a reaction applied to the lead and the lead feeding mechanism rom a sheet surface is dampened under a combination of the springs in case that a writer showing a strong writing pressure writes.

In order to accomplish the above-described objects, the rotary knock type mechanical pencil of the present invention is comprised of a cam cylinder which has a cam surface at its extremity end and is integrally rotated with a rearward outer cylinder; and a lead feeding mechanism including a lead guide having at its rear end side a cam engaging means to be engaged with the cam surface of the cam cylinder, at its extremity end side a lead chuck capable of holding or releasing of a lead connected thereto and stored in the forward outer cylinder in such a way as it may be advanced or retracted under a rotation of the cam cylinder; a tightening ring for fastening or releasing the extremity end side of the chuck fixed to the lead guide; a sleeve arranged at an outer circumferential side of the chuck so as to restrict a movement of the ring toward the rear end direction which is advanced or retracted together with the chuck; and a slider arranged within a member at the extremity end of the shaft to hold an outer circumference of the lead with a specified frictional force and sliding in the member at the extremity end.

BRIEF DESCRIPTION OF THE DRAWINGS

FIG. 33 is a front elevational view showing a resilient opening or closing part.

DETAILED DESCRIPTION OF THE PREFERRED EMBODIMENT

Figure 1:
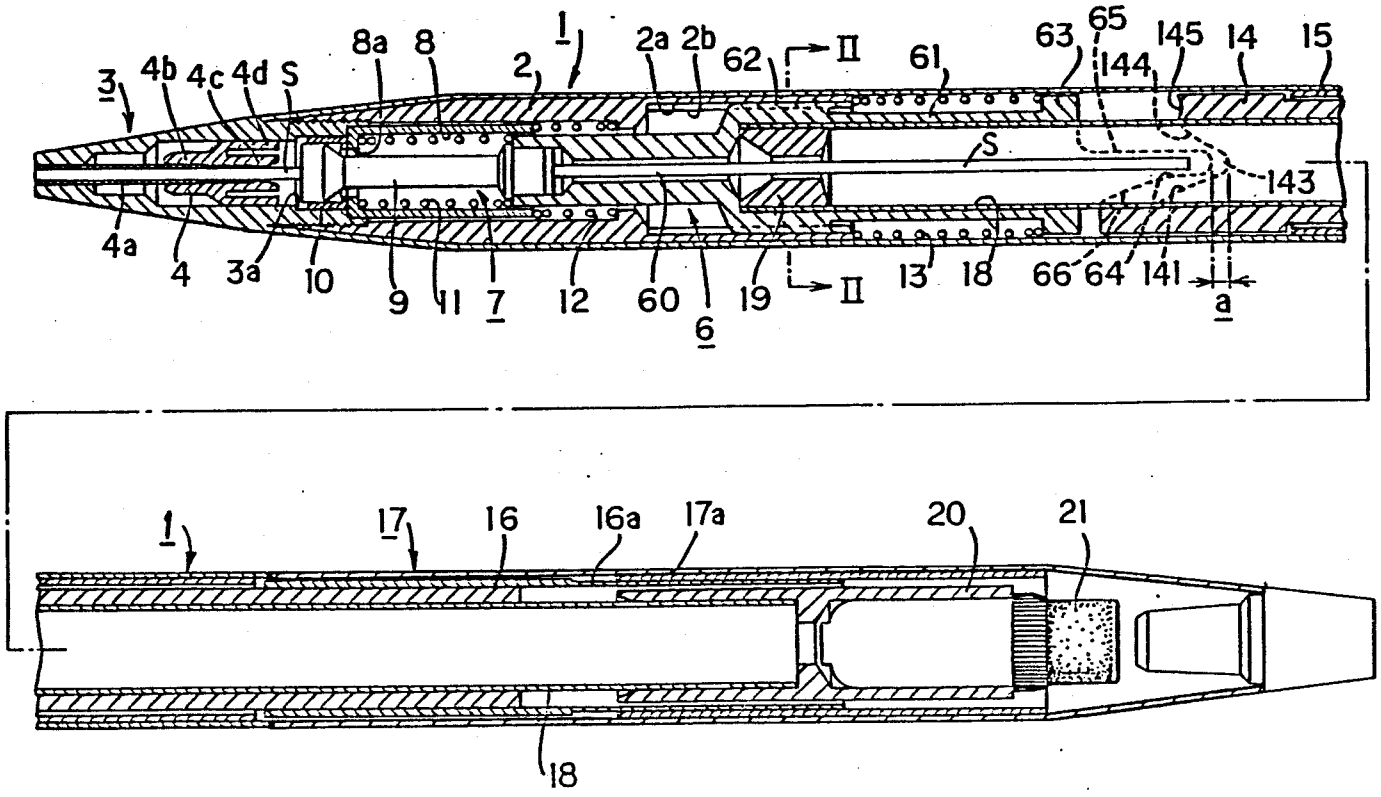
FIG. 1 is a sectional view for showing a mechanical pencil of the first preferred embodiment of the present invention.

Referring now to the drawings, preferred embodiments of the present invention will be described.

In FIG. 1, there is shown a mechanical pencil of the first preferred embodiment. Reference numeral 1 designates a forward outer cylinder, reference numeral 2 a forward inner cylinder which is engageably inserted into the forward outer cylinder 1 from a rear end thereof. A rear end side of a tip element 3 is engageably screwed into the forward end of the forward inner cylinder 2.

The tip element 3 and the forward inner cylinder 2 are fastened and fixed through this screw threading.

Within the tip element 3, a slider 4 is axially and slidably arranged for projection out of or retraction into the extremity end of the tip element.

The slider 4 is comprised of a lead guide pipe 4*a* and a slider member 4*b* fixed to the rear end of the lead guide pipe 4*a*, supporting a lead S at the inner circumferential surface with a specified frictional resistance and sliding against an inner circumferential surface of the tip element 3 at the outer circumferential surface of the slider under a larger frictional resistance than the above-mentioned specified frictional resistance.

The slider member 4*b* is integrally made of ABS resin or polyacetal or the like, and has a resilient sliding piece 4*c* for supporting a lead S sliding with the lead guide 4*a* with the above-mentioned specified frictional resistance and a sliding piece 4*d* sliding contacted with an inner circumferential surface of the tip member 3 arranged in an outer diametrical direction of the sliding contact piece 4*c* with a larger frictional resistance than the above-mentioned frictional resistance.

In turn, a rear large diameter inner hole 2*a* of a large diameter stepped shape is arranged at the rear part of the forward inner cylinder 2.

A lead guide 6 is axially and slidably inserted into the forward inner cylinder 2 from the rear large diameter inner hole 2*a* and a lead feeding mechanism 7 is arranged at an extremity end of the lead guide 6.

The lead feeding mechanism 7 is comprised of a sleeve 8 axially and slidably inserted into the forward inner cylinder 2, a lead chuck 9 fitted and connected to an extremity end of the lead guide 6 and axially and movably inserted into the sleeve 8, a chuck tightening ring 10 outwardly fitted to the extremity end of the lead chuck 9, and a first resilient body 11, such as a spring, is resiliently fitted between a projection 8*a* inwardly projected into the extremity end of the sleeve 8 and the extremity end of the lead guide 6.

Within the forward inner cylinder 2, a second resilient body 12, such as a spring, is provided for biasing the sleeve 8 in a forward direction.

The lead guide 6 has a lead insertion hole 60 arranged from a part near its intermediate portion to an axial central part at the extremity end and a large diameter cylinder 61 integrally formed at the rear end part of the lead insertion hole 60 and axially and slidably fitted into the rear large diameter inner hole 2*a* of the forward inner cylinder 2. This large diameter cylinder 61 is extended into the forward outer cylinder 1.

Although the lead guide 6 can be axially slid within the forward inner cylinder 2, this guide is engaged within the forward inner cylinder 2 fixed against rotation.

Figure 2:
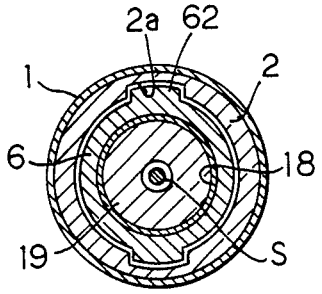
FIG. 2 is a sectional view taken along a line II—II of FIG. 1.

As shown in FIGS. 1 and 2, a rotation preventive projection 62 integrally projected at a forward outer circumferential surface of the large diameter cylinder part 61 of the lead guide 6 is, as this engaging means, fitted and engaged in an axial groove 2*b* formed in the rear large diameter inner hole 2*a* of the forward inner cylinder 2. This engaging means may be made such that the rotation preventive projection 62 is integrally projected at the rearward large diameter inner hole 2*a* and the axial groove 2*b* may be formed at an outer circumferential surface of the large diameter cylinder part 61.

Figure 3:
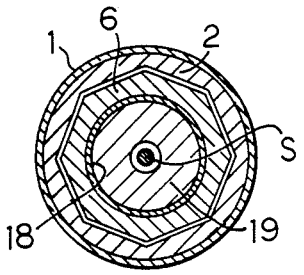
FIG. 3 is a sectional view for showing the second preferred embodiment of the present invention which is a modified form of the invention.

As found in the second preferred embodiment shown in FIG. 3, an inner circumferential surface of the rearward large diameter inner hole 2*a* and an outer circumferential surface of the large diameter cylinder part 61 may be formed as a regular polygonal shape, they may be axially and slidably fitted to each other to make the engaging means.

The lead guide 6 is biased in its retracting direction by a third resilient body 13, such as a spring, resiliently fitted between an outward projection 63 at its rear end and the rear end of the forward inner cylinder 2.

The third resilient body 13 is for fastening the lead chuck 9 with the chuck tightening ring 10 by rearwardly moving the lead chuck 9 integrally with the lead guide 6. The first and third resilient bodies 11 and 13 may perform the same action, so either one of them may be eliminated.

The rearward circumferential wall of the lead guide 6 is integrally formed with a cam engaging piece (cam engaging means) 64. A cam cylinder 14 is inserted into the rear part of the forward outer cylinder 1 in such a manner as it may be rotated at its specified position.

Now, a relative construction of the cam cylinder 14 and the cam engaging piece 64 will be described.

The cam engaging piece 64 has a stopper surface 65 axially extending so as to restrict one-directional rotation of the cam cylinder 14 and a curved slant surface 66 formed around a substantial half circumference of a circumferential wall from the extremity end of the stopper surface 65.

Figure 4:
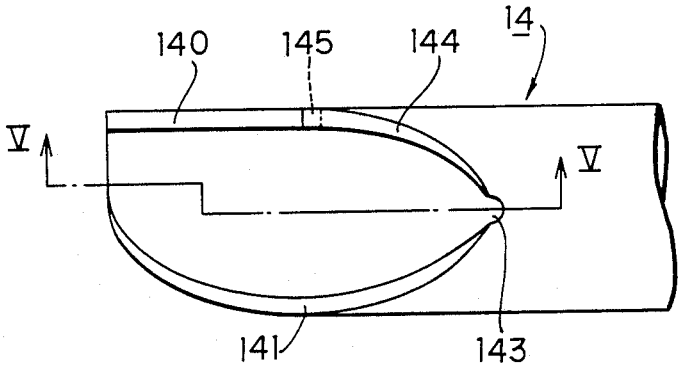
FIG. 4 is a top plan view of a cam cylinder of the mechanical pencil of the first preferred embodiment of the present invention.
Figure 5:
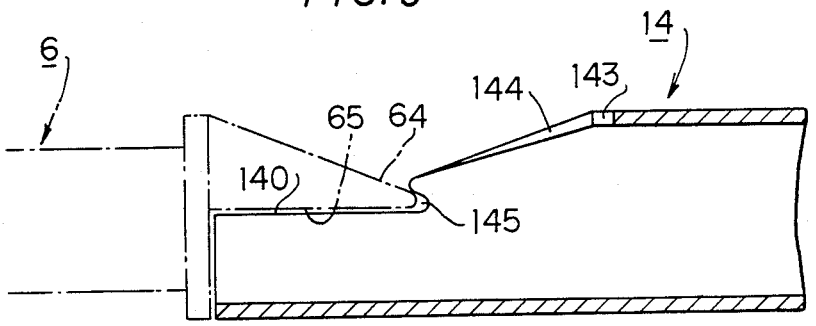
FIG. 5 is a sectional view taken along a line V—V of FIG . 4.
Figure 6:
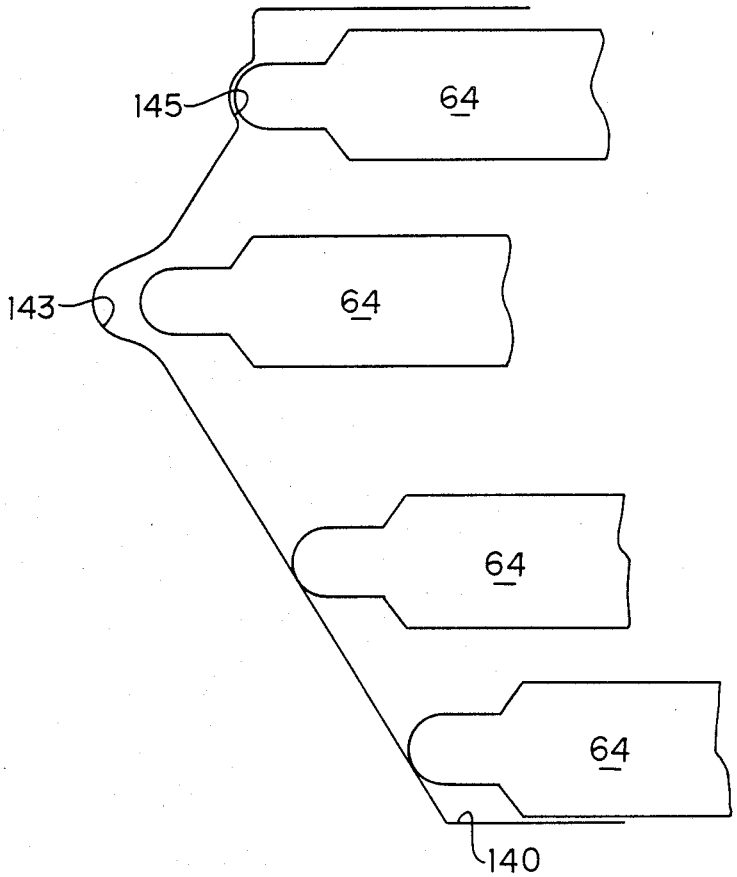
FIG. 6 is a developed view for illustrating an action of the cam cylinder.

The cam cylinder 14 is provided at its forward end an axially extending stopper surface 140 engageably or disengageably abutted against the stopper surface 65 (see FIGS. 4 and 5), a large cam surface 141 curved and slanted from an extremity end of the stopper surface 140 to its substantial half circumference thereof, a small cam surface 144 curved and slanted from the rear end engaging part 143 arranged at the rear end of the large cam surface 141 to the rear end of the stopper surface 140, and an intermediate engaging part 145 arranged at a front end of the small cam surface 144 and at a rear end of the stopper surface 140. Each of the rear end engaging part 143 and the intermediate engaging part 145 is formed as a concave form.

The rear end of the cam engaging piece 64 is press engaged under a biasing force of the third resilient body 13 with any one of the large cam surface 141, the rear end engaging part 143 and the small cam surface 144 of the cam cylinder 14.

In the cam cylinder 14, the rear end engaging part 143 defines a writing position and the intermediate engaging part 145 is defines a chuck releasing and locked position when the lead is to be stored, the large cam surface 141 is a cam surface for use in feeding the lead also acting as means for feeding the lead guide 4*a*, and the small cam surface 144 is a cam surface for releasing the chuck.

Thus, the cam engaging piece 64 is pushed with the large cam surface 141 under one directional rotation of the cam cylinder 14, the cam engaging piece 64 is substantially moved toward the extremity end of the large cam surface 141, thereby the lead guide 4*a* is projected out of the tip element 3 and as the cam cylinder 14 is reversely rotated in an opposite direction after projection, the cam engaging piece 64 is advanced again with the large cam surface 141 and then the lead S is fed out from the extremity end of the lead guide 4*a*. Further, as the cam cylinder 14 is substantially rotated in an opposite direction, the cam engaging piece 64 is engaged with the intermediate engaging part 145 along the small cam surface 144 and thus the lead feeding mechanism 7 is kept at the chuck released condition.

Therefore, under the chuck released condition, as the lead S projected from the extremity end of the lead guide pipe 4a is pushed against a paper sheet or the like, the lead S is retracted back into the lead guide pipe 4a and then the slider 4 is retracted and stored in the tip element 3 together with the lead S.

With this arrangement, in case of carrying the writing instrument, there is no chance for the lead guide 4a to project out of the extremity end of the tip element 3 and so it is possible to prevent damage to the cloth, for example, of a shirt pocket, or the like, with the projected extremity end of the lead guide 4a in advance.

In this case, as shown in FIG. 1, a distance a acting as a margin for absorbing a shock is arranged between the rear end of the cam engaging piece 64 and the rear end engaging part 143.

Hence, in case an excessive writing pressure is applied to the lead during writing operation, the second cushion resilient body 12 is compressed in order to prevent a breakage of the lead S or the like and then the lead pipe 18 is retracted and stored in the cylinder.

Thus, as the cam engaging piece 64 of the lead guide is abutted against the cam cylinder 14 under this retraction and storing condition, this results in generating a forward pressing force for the lead feeding mechanism 7, so that the lead chuck 9 is released to generate a looseness of the lead. A distance a acting as a margin of cushion is provided to prevent the sliding of the lead.

An intermediate ring 15 is rotatably and freely fitted in an outer circumferential surface of the cam cylinder 14 and this intermediate ring 15 is fitted and fixed to a rear inner side of the forward outer cylinder 1.

To the rear end of the cam cylinder 14 is integrally connected a rear side cylinder 16 and a rear side outer cylinder 17 is engageably or disengageably press fitted to the rear side cylinder 16.

Under this press fitted condition, the rear side cylinder 16 and the rear side outer cylinder 17 are engaged at their axial directions with their frictional engaging force, thereby the cam cylinder 14 is rotatable together with the rear side outer cylinder 17. As shown in FIG. 1, an axial groove 16a is arranged at an outer circumferential surface of the rear side cylinder part 16 and a rotation preventive projection 17a is arranged at an inner circumferential surface of the rear side outer cylinder 17, respectively , and this rotation preventive projection 17a is fitted and engaged with the axial groove 16a, thereby the rear side cylinder 16 of the cam cylinder 14 may be engaged within the rear side outer cylinder 17 in an axial direction and so any engaging means can be applied.

Within the cam cylinder 14 is removably inserted a lead pipe 18 from its rear portion, and the extremity end of the lead pipe 18 is removably inserted into the large diameter cylinder 61 of the lead guide 6.

Therefore, the lead pipe 18 comprises a lead cartridge which can be removed from the lead guide 6 and the cam cylinder 14 in the preferred embodiment. The lead pipe 18 may be made integrally with either the lead guide 6 or the lead chuck 9 which is connected at its extremity end. The lead pipe 18 is also detachably inserted into the interior of a sliding element 22. Thus the lad pipe 18 penetrates the interior of the cam cylinder 14 and the sliding element 22 so as to provide functions for positioning and guiding the cam cylinder 14 and the sliding element 22.

In such a lead pipe 18 as described above, a lead guide member 19 is arranged within the extremity end and further a rubber eraser receiving cylinder 20 is integrally connected to the rear end part.

To this rubber eraser keeping cylinder 20 is fitted or supported a base end part of the rubber eraser 21.

The assembly of the writing instrument will now be described. At first, after the forward inner cylinder 2 is inserted into the forward outer cylinder 1 at its rearward end, the tip element 3 is threadably engaged in the extremity end of the forward inner cylinder 2.

With this arrangement, the forward inner cylinder 2, the lead feeding mechanism 7 and the lead guide 6 are fitted and set in the forward outer cylinder 1 under their united condition.

Then, the cam cylinder 14 is inserted into the rear end side of the forward outer cylinder 1 and the intermediate ring 15 is fitted and fixed to the rear end inner part of the forward outer cylinder 1.

Under this condition, the lead pipe 18 is inserted into the cam cylinder 14 from its rear end, thereby the extremity end of the lead pipe 18 is fitted into the large diameter cylinder 61 of the lead guide 6.

After that, the rear side outer cylinder 17 is press fitted into the rear side cylinder 16 of the cam cylinder 14 from the rear end of the lead pipe 18 to complete an assembling operation of the writing instrument.

Now, operation of the writing instrument will be described. When the cam engaging piece 64 of the lead guide 6 is engaged with the intermediate engaging part 145 of the cam cylinder 14, each of the lead guide pipe 4a and the lead S is retracted and stored in the tip element 3.

As the rear outer cylinder 17 is substantially rotated in one direction from this condition, the cam cylinder 14 is integrally rotated together with the rear outer cylinder 17, thereby the engaged condition between the intermediate engaging part 145 and the cam engaging piece 64 is released, and the cam engaging piece 64 is moved toward the large cam surface 141 through the small cam surface 144.

When the cam engaging piece 64 is pushed with the large cam surface 141, the lead guide 6 which is integral with the cam engaging piece 64 is advanced and the lead guide pipe 4a of the slider 4 is then projected from the tip element 3 through the lead feeding mechanism 7.

Then, after the rear part outer cylinder 17 is rotated back in an opposite direction, and again slightly rotated in one direction, the cam engaging piece 64 is advanced again with the large cam surface 141 of the cam cylinder 14 which is integrally rotated with the rear part outer cylinder 17.

With this arrangement, the lead feeding operation is carried out to feed out the lead S from the lead guide 4a.

In this case, a repetition of a normal or an opposite rotation of the cam cylinder 14 caused by the rear outer cylinder 17 may adjust a feeding length of the lead.

After such a lead feeding operation, the cam engaging piece 64 is positioned at the rear end engaging part 143 of the cam cylinder 14 and so a writing can be performed.

When the cam cylinder 14 is substantially rotated in an opposite direction with the rear outer cylinder 17, the cam engaging piece 64 is moved to the small cam surface 144, the cam engaging piece 64 is advanced with the small cam surface 144 and then the lead guide 6 and the lead feeding mechanism 7 are advanced together with the cam engaging piece 64.

During this advancing process, the chuck tightening ring 10 is abutted at its front end against a rear step 3*a* in the tip element 3 and stopped there. The lead chuck 9 is further advanced to cause the fastening with the chuck tightening ring 10 to be released, resulting in making a chuck released condition and under this condition the cam engaging piece 64 is engaged with and locked with the intermediate engaging part 145.

Therefore, under this condition, if the lead S projecting from the lead guide pipe 4*a* and the lead guide pipe 4*a* are pushed against the paper sheet or the like, these lead S and the lead guide pipe 4*a* are gradually retracted and stored in the tip element 3.

Further, since the slider 4 may apply a desired frictional force against the lead S and the inner circumferential surface of the tip element 3 through the slider member 4, a mere pushing of the extremity end of the lead S against the paper sheet or the like without applying any knocking action when the lead guide pipe 4*a* is at a retractable position enables the lead S to be projected by a desired length. This can be accomplished with a simple construction and assembly operation, without the use of a cylinder or a frictional member as found in the prior art, but by using a slider member 4*b* acting as one synthetic resin molded product.

Since a large amount of slider member 4*b* can be obtained less expensively and a length of the slider member can be reduced, it may be helpful for shortening an entire length of the mechanical pencil.

Thus, it is not necessary to feed a lead under a knocking operation while the lead S is consumed by an amount corresponding to a distance where the lead guide pipe 4*a* can move and so a subsequent writing can be continued without regripping of the pencil.

Figure 7:
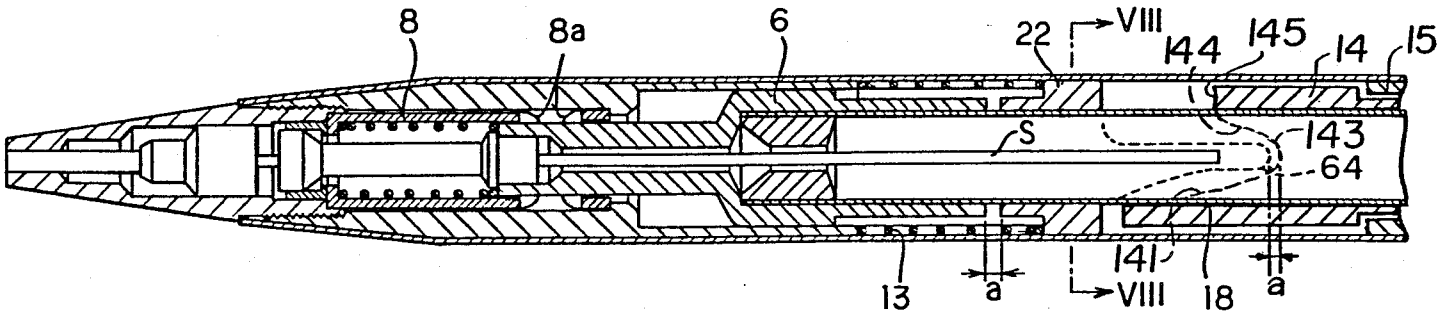
FIG. 7 is a sectional view for showing a substantial part of the mechanical pencil of the third preferred embodiment of the present invention.
Figure 8:
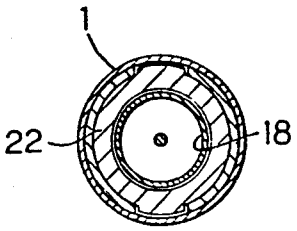
FIG. 8 is a sectional view taken along a line VIII—VIII of FIG. 7.

In FIG. 7 is illustrated the third preferred embodiment. In this embodiment, the second resilient body 12 shown in FIG. 1 is eliminated by providing a so-called cushion sleeve 8 having a cushion part 8*a* axially extendable or retractable formed integrally with the rear end side of the sleeve 8 shown in FIG. 1. Further, in this embodiment, a slider 22 which is separate from the lead guide 6 is arranged at the rear end of the lead guide 6. This slider 22 is axially and slidably inserted into the rear portion of the forward outer cylinder 1, engaged at its axial portion and biased by the third resilient body 13 in a retracting direction. Then, the cam engaging piece 64 is integrally formed with the rear end of the slider 22. In case of this preferred embodiment, there is provided a distance a acting as a margin of cushion between the rear end of the lead guide 6 and the front end of the slider 22. Therefore, also in this embodiment, the same actions and effects as those of the first and second preferred embodiments can be attained.

Referring now to FIGS. 9 to 23, the fourth preferred embodiment of the present invention will be described. The fourth preferred embodiment is provided for facilitating an assembling operation, wherein the outer cylinder 1 is comprised of a forward outer cylinder 1*a* and a rearward outer cylinder 1*b* rotatably connected to the forward outer cylinder 1*a*.

As described later, rotation of the rearward outer cylinder 1*b* performs (i) a lead feeding operation for the lead S, (ii) a forward movement of the slider 4 and (iii) a releasing of the lead chuck 9 and a storing of the slider 4.

Thus, within the outer cylinder 1 are provided a barrel adapter 50 press fitted and fixed, a lead feeding mechanism 7, a lead pipe 18 provided with an opening or closing mechanism 70 and a rotary cam mechanism 90.

The lead feeding mechanism 7 has a mechanism adapter 100 fixed to the barrel adapter 50 (see FIG. 10), a cassette adapter 110 slidably arranged in the mechanism adapter 100 and engaged via a projection 110*a* in an axial groove 100*a* projection 110*a* is formed from the rear end of the mechanism adapter 110 forwardly (see FIGS. 9 and 11), a lead chuck 9 fitted to the extremity end of the cassette adapter 110, a chuck tightening ring 10 externally fitted to a head part of the lead chuck 9, a sleeve 8 abutted against the rear part of the chuck tightening ring 10 and slidably arranged within the mechanism adapter 100, a second resilient body 13 resiliently fitted between the sleeve 8 and the stepped part 100*b* of the mechanism adapter 100, and a first resilient body 11 for use in tightening a chuck is resiliently fitted between the sleeve 8 and the cassette adapter 110.

To the extremity end of the mechanism adapter 100 is removably fitted the tip element 3 and in turn to the rear side is fitted a cylindrical upper housing 160.

Within the tip element 3 is slidably arranged a slider 4.

This slider 4 is comprised of a lead guide pipe 4*a* and a slider member 4*b* fixed to the rear end of the lead guide pipe 4*a* and supporting the lead at its inner circumferential surface with a specified frictional resistance.

To the inner wall of the extremity end of the tip element 3 is fixed a lead guide friction applying part 170 slidably contacting with the lead guide pipe 4*a* with a larger frictional force than the lead frictional resistance of the slider member 4*b*.

The slider member 4*b* is integrally formed by ABS resin or polyacetal or the like.

Figures 9A, 9B, 10, 33A, 33B, 33C:
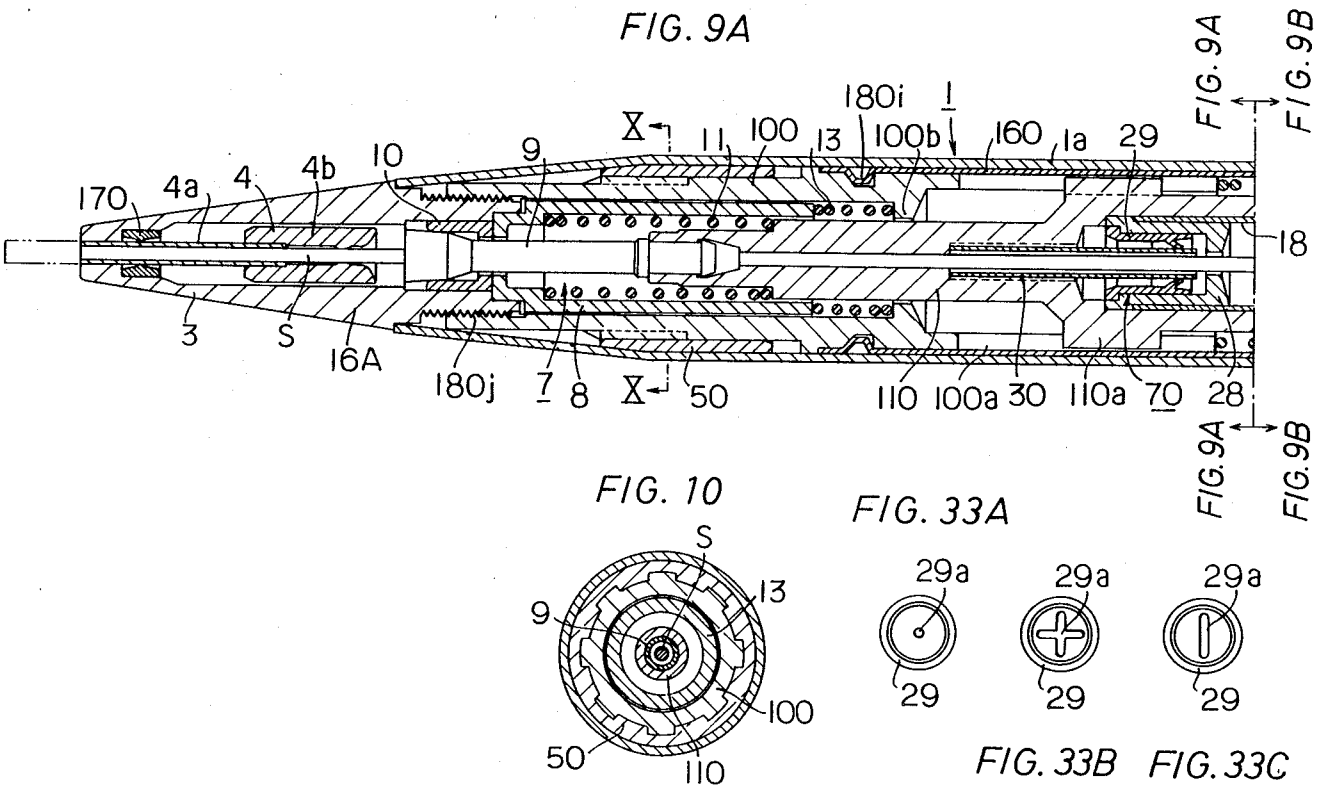
FIGS. 9A, 9B and 9C illustrate a longitudinal section of a fourth preferred embodiment of the mechanical pencil of the present invention, respectively representing a front section, a midsection and a rear section of the pencil.
FIG. 10 is a sectional view taken along a line X—X of FIG. 9A.
Figure 11A:
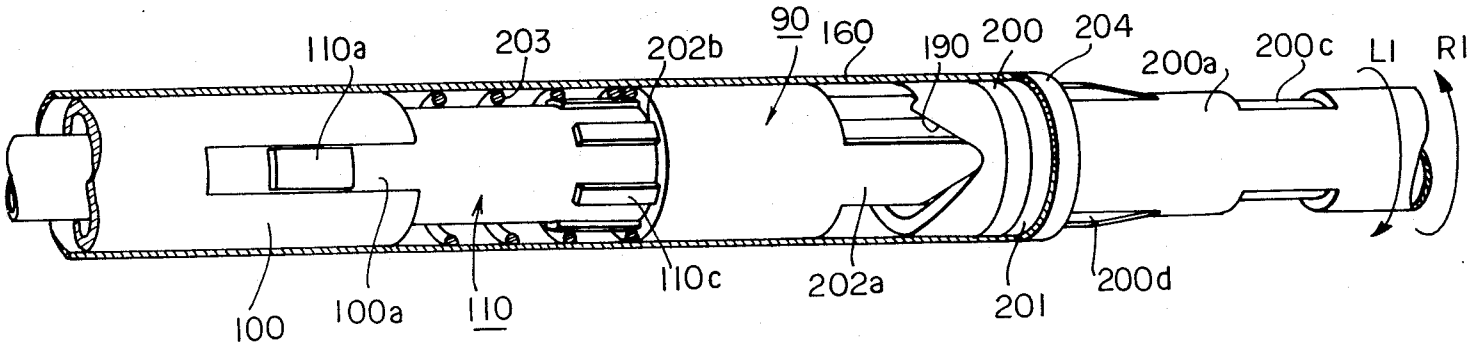
FIG. 11A and FIG. 11B are an illustrative perspective view showing a rotary cam mechanism.
Figure 11B:
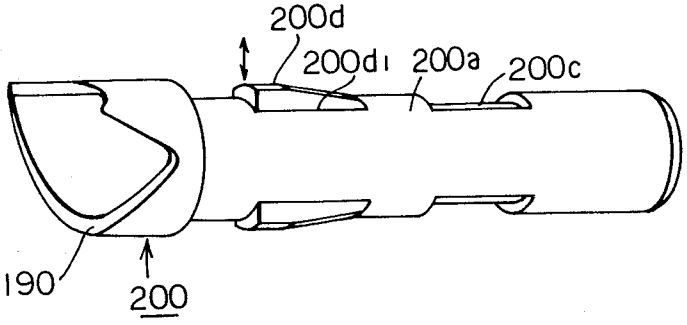

As shown in FIGS. 9B and 11, the rotary cam mechanism 90 is rigidly connected and fixed to a driver 180 described hereafter. The rotary cam mechanism 90 is provided with a cam 200 having the cam surface 190 inserted into the upper housing 160, a cam bearing 201 and a cam follower 202 (see FIG. 9B) having a sliding element 202*a* abutting against the cam surface 190 of the cam 200, as seen in FIG. 11A, sliding axially under a rotation of the cam 200 and feeding the lead S.

Between the cam follower 202 and the mechanism adapter 100 is resiliently fitted a third return resilient body 203. The sliding element 202*a* of the cam follower 202 is always press abutted against the rearward cam surface 190 to prevent an axial rotation of the cam follower 202.

At the extremity end of the cam follower 202 is formed an adapter hole 202*b* axially and slidably storing and engaging with the rear end of the cassette adapter 110.

Figure 9B:
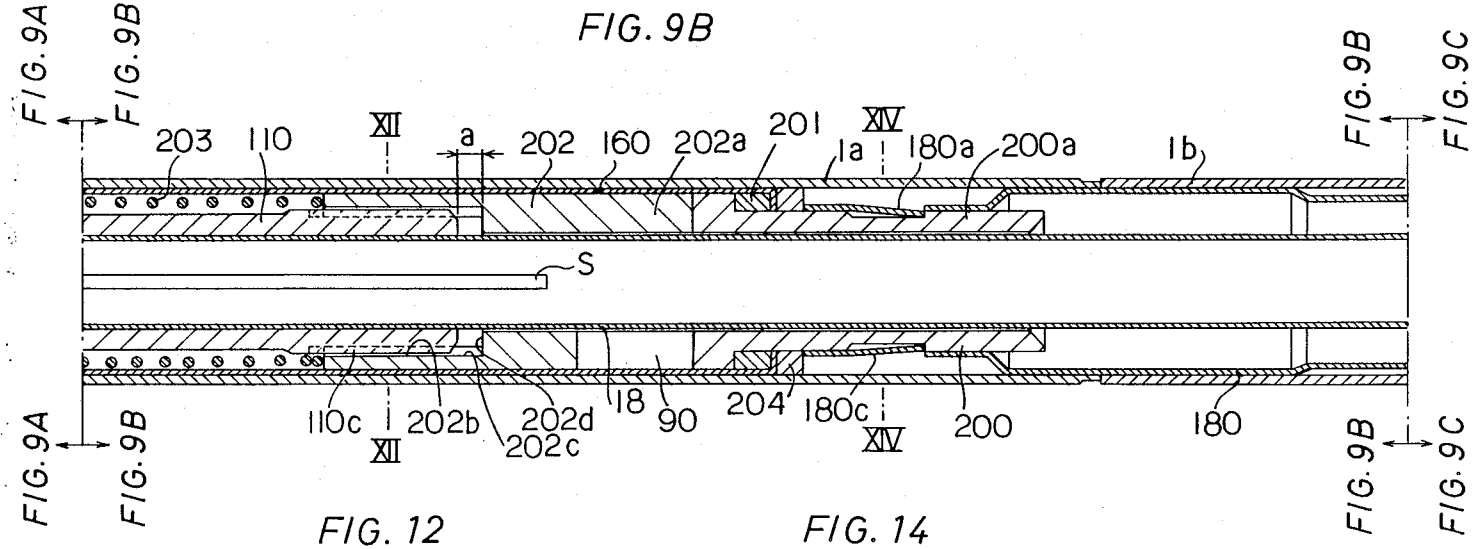
Figure 12:
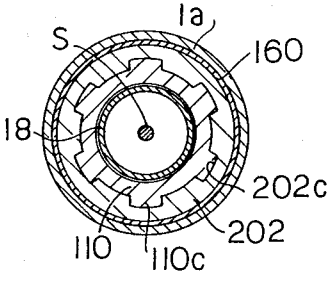
FIG. 12 is a sectional view taken along a line XII—XII of FIG. 9B.
Figures 9B, 9C:
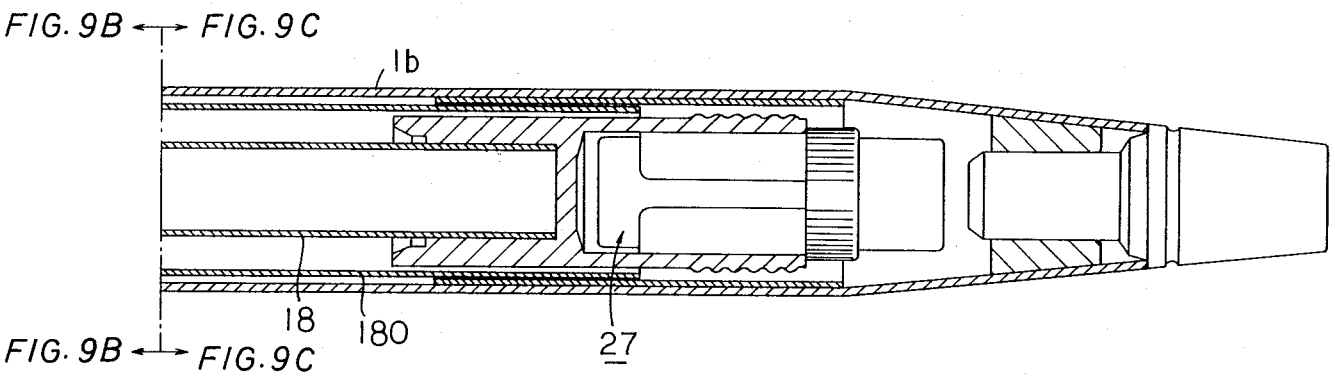

As shown in FIGS. 9, 11 and 12, in the adapter hole 202*b* is axially formed an adapter rotation preventive groove 202*c* engaging with the rotation preventive projection 110*c* of the cassette adapter 110, restricting an axial rotation of the cassette adapter 110 and integrally rotated with the cam 200. In FIG. 9, the distance a between the rear end of the cassette adapter 110 and an inner wall stepped part 202*d* of the cam follower 202 is a margin of cushion. That is, as described later, this distance is a space applied in case that the lead chuck 9 and the cassette adapter 110 or the like are retracted and moved when an excessive writing pressure is applied to the lead S and also a retraction tolerance amount.

Figure 13:
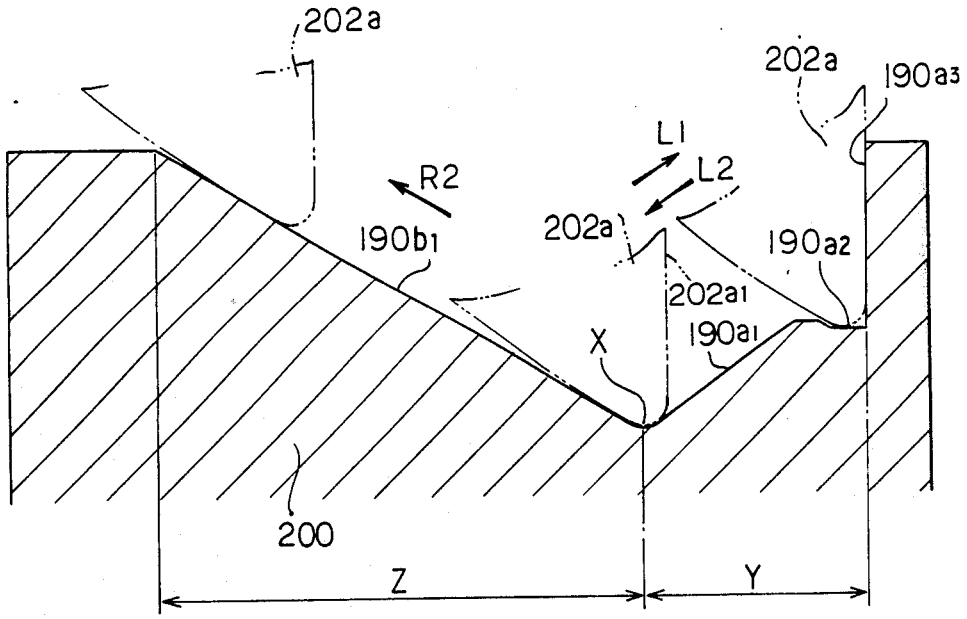
FIG. 13 is a developed illustrative view for showing a cam surface.

Referring now to FIGS. 11 and 13, the cam surface 190 of the cam 200 and the structure of the sliding element 202*a* of the cam follower 202 will be described.

At first, the sliding element 202*a* has a stopper surface 202$a_1$ axially extending in order to restrict one directional rotation of the cam 200.

In turn, the cam surface 190 is comprised of (i) a released cam surface area Y for releasing the lead chuck with the point X being as an interface point, and (ii) a knock cam surface area Z where the slider 4 may advance or perform a feeding of lead.

Then, the condition in which the sliding element 202*a* is positioned at the point X corresponds to the normal cases such as a writing time and a non-writing time or the like other than a lead feeding operation, a slider 4 moving operation and a lead chuck 9 releasing operation.

The released cam surface area Y is comprised of a released and curved cam surface 190$a_1$ extending from a point X in one direction in a curved form, a sliding element stopped part 190$a_2$ formed at the terminal end of the released and curved cam surface 190$a_1$ and a released stopper surface 190$a_3$ abutting against the stopper surface 202$a_1$ of the sliding element 202*a*.

Then, when the cam 200 is rotated as indicated by an arrow $L_1$ in FIG. 11, the lead chuck 9 is gradually released as the sliding element 202*a* is moved from the point X on the curved cam surface 190$a_1$ as indicated by an arrow $L_2$ in FIG. 13 and as described later it is applied as a chuck released and locked position when the slider 4 can be stored.

In turn, the knock cam surface area Z has a knock curved cam surface 190$b_1$ extending from the point X to other directions as shown in FIG. 13.

The knock curved cam surface 190$b_1$ may act as a cam surface for use in feeding a lead and advancing the slider 4.

That is, as the cam 200 is rotated as indicated by an arrow R1 in FIG. 11A, the sliding element 202*a* is moved by the knock curved cam surface 190$b_1$ as shown by an arrow R2 in FIG. 13, and during this process, a lead feeding mechanism such as the cam follower 202, cassette adapter 110 and lead chuck 9 or the like is advanced. In case the rotation of the cam 200 is slightly rotated (in case of a small knock), only a lead feeding operation is performed. In case a rotation of the cam 200 is substantially increased (in case of a strong knock), the lead feeding mechanism 7 is further advanced, so that a pushing and advancement of the slider 4 are carried out in addition to the lead feeding operation.

To the cam 200 is connected and fixed a driver 180 having a rearward outer cylinder 1*b* fitted and fixed thereto through various means. In FIGS. 9 and 11, a reference numeral 204 designates a driver bearing.

Figure 14:
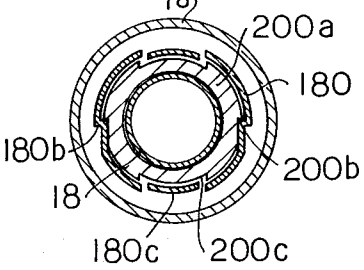
FIG. 14 is a sectional view taken along a line XIV—XIV of FIG. 9B.

FIGS. 9B and 14 indicate a first connecting and fixing means for the cam 200 and the driver 180. In this preferred embodiment, an outer circumferential surface of the cam rod 200*a* of the cam 200 is formed with a driver engaging stepped part 200*b* and a rotation preventive groove 200*c*.

In turn, a fitting part 180*a* of the driver 180 is substantially formed as a cylindrical shape in such a manner as the cam rod 200*a* is outwardly fitted, an inner stepped part 180*b* is engaged with the driver engaging stepped part 200*b*, an inner projecting piece 180*c* is engaged with the rotation preventive groove 200*c* so as to fixedly fit them to each other.

FIGS. 11A, 11B and 15 to 19 show the second connecting means. In the preferred embodiment, the cam rod 200*a* is formed with a rotation preventive groove 200*c* and an engaging projecting piece 200*d* projected outwardly and projectable or retractable in a diametrical direction. In turn, the substantial cylindrical fitting part 180*a* of the driver 180 is formed with an inner projecting piece 180*c* engaged with the rotation preventive groove 200*c* and a concave part 180*d* for holding and press fitting the engaging projection piece 200*d*, the fitting part 180*a* is press fitted to the cam rod 200*a*, and both of them are forcedly fitted to each other.

Figure 15:
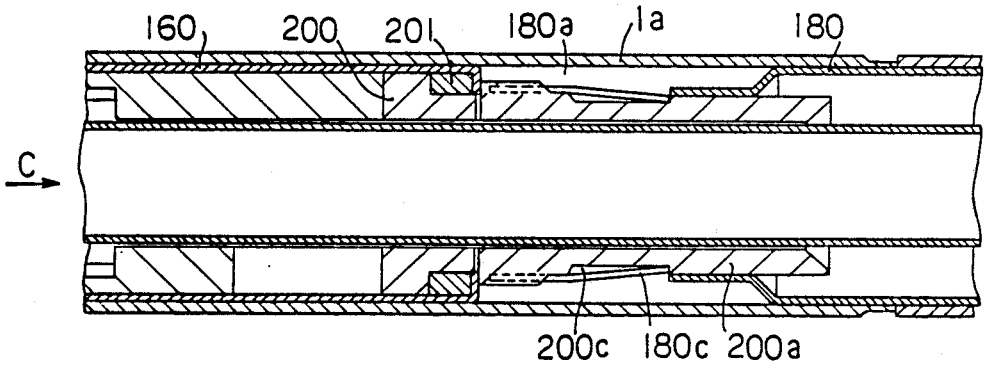
FIG. 15 is a longitudinal section illustrating a second connecting means between a cam and a driver.
Figure 18:
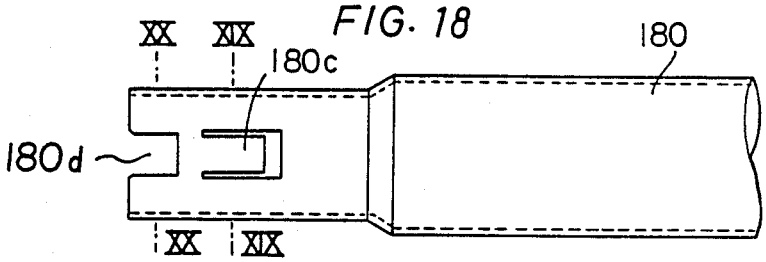
FIG. 18 is a top plan view showing a driver.
Figure 19B:
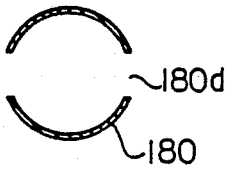
FIG. 19B is a sectional view taken along a line XX—XX of FIG. 18.
Figure 19A:
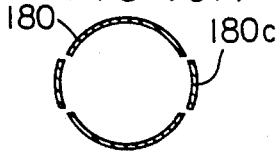
FIG. 19A is a sectional view taken along a line XIX—XIX of FIG. 18
Figure 17A:
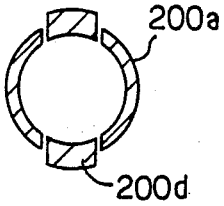
FIG. 17A is a sectional view taken along a line A—A of FIG. 16.
Figure 17B:
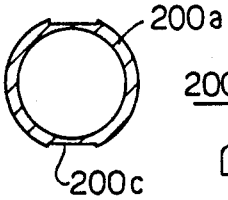
FIG. 17B is a sectional view taken along a line B—B of FIG. 16.
Figure 16:
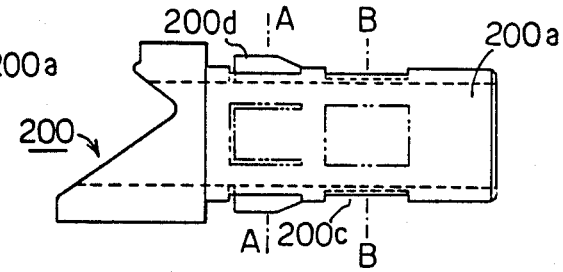
FIG. 16 is a side elevational view showing a cam.

As the cam 200 is inserted into the upper housing 160 from a direction indicated by an arrow (C) of FIG. 15 and the engaging projection piece 200*d* of the cam rod 200*a* passes through the driver bearing 204, the engaging projection piece 200*d* is projected in a diametrical direction and formed in such a manner as it may not be dropped off the driver bearing 204. As indicated in FIG. 11, a wedge or the like is press fitted into the groove 200$d_1$ of the engaging projection piece 200*d* and a more positive projecting position is assured. The driver bearing 204 may be eliminated as shown in FIG. 15.

Figure 20:
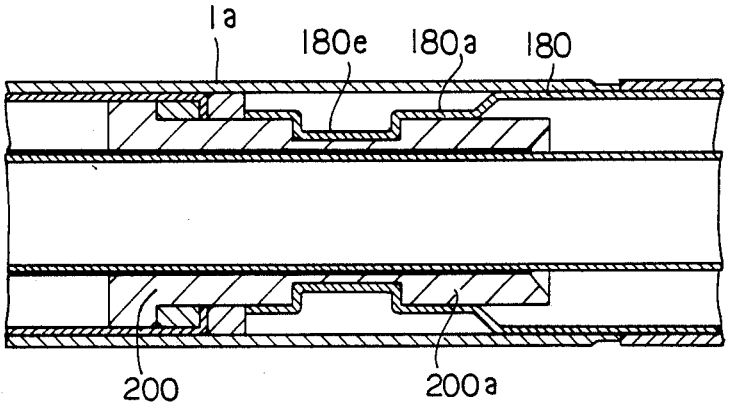
FIG. 20 is a longitudinal section showing the third connecting means.
Figure 22:
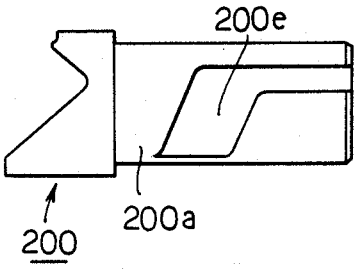
FIG. 22 is a side elevational view for showing a cam.
Figure 21:
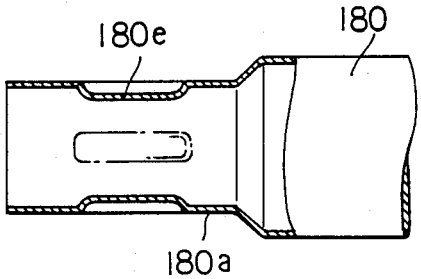
FIG. 21 is a partial longitudinal section for showing a driver.

FIGS. 20 to 22 illustrate the third connecting means, wherein a plurality of inner stepped portions 180*e* are formed at the fitting part 180*a* of the driver 180 and inserted into a bent groove 200*e* formed at the cam rod 200*a* of the cam 200, twisted, engaged and fitted therein.

Figure 23:
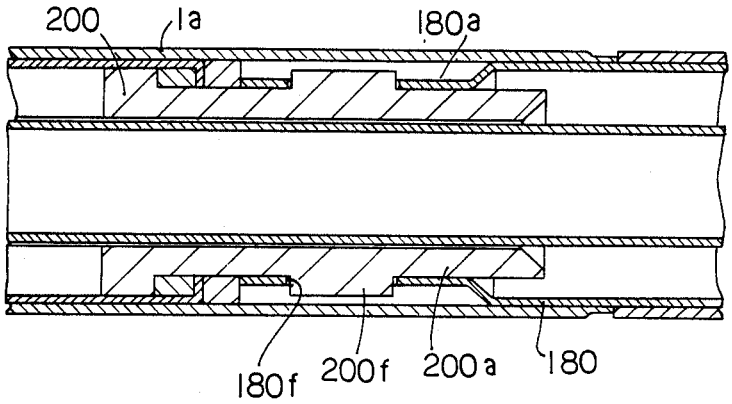
FIG. 23 is a longitudinal section for showing the fourth connecting means.
Figure 25:
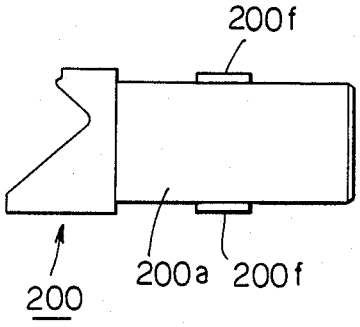
FIG. 25 is a side elevational view for showing a cam.
Figure 24:
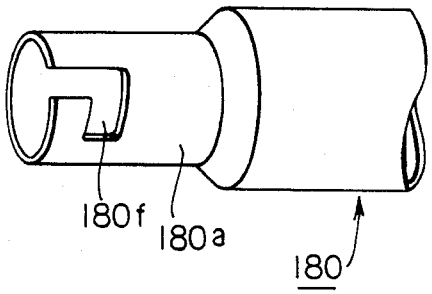
FIG. 24 is a perspective view for showing a driver.

FIGS. 23 to 25 illustrate the fourth connecting means, wherein a projecting part 200*f* is formed at a cam rod 200*a* of the cam 200, it is inserted into a bent groove 180*f* of the fitted part 180*a* of the driver 180 and twisted, thereafter press fitted.

Figure 26:
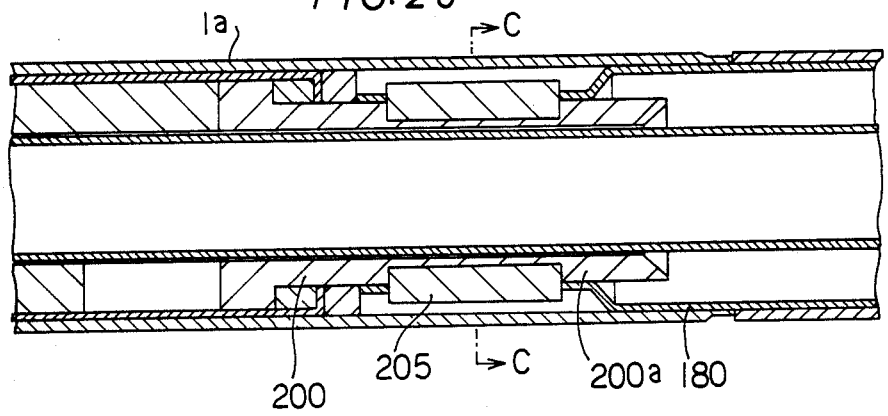
FIG. 26 is a longitudinal section for showing the fifth connecting means.
Figure 27:
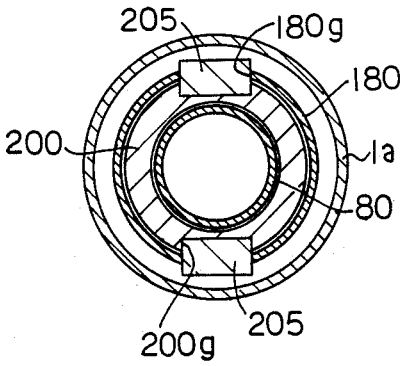
FIG. 27 is a sectional view taken along a line C—C of FIG. 26.

FIGS. 26 to 28 illustrate the fifth connecting means, wherein a fitting part 180*a* of the driver 180 is press fitted into the cam rod 200*a* and both of them are formed with insertion grooves 180*g* and 200*g*. The insertion grooves 180*g* and 200*g* are coincided to each other, a press engaging member 205 for generating a lateral pushing force is press fitted into the grooves so as to forcedly fit and fix the cam rod 200*a* and the fitting member 180*a*.

Figure 28A:
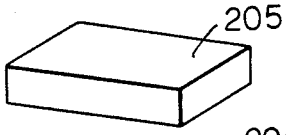
FIGS. 28A, 28B and 28C are perspective views showing alternate press fitting engaging members.
Figure 28B:
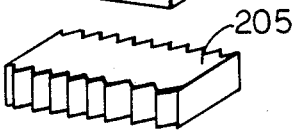
Figure 28C:
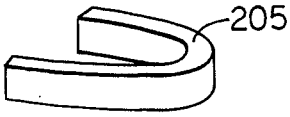

In this case, the press fitting engaging member 205 may be formed in any shape if it may generate a lateral pressing and fitting force for fitting the cam rod 200*a* and the fitting part 180*a*, and for example, one shown in FIG. 28A to FIG. 28C can be illustrated. In the preferred embodiment, two fitting and engaging members 205 are press fitted and one or more than three fittings may be applied.

Figure 29:
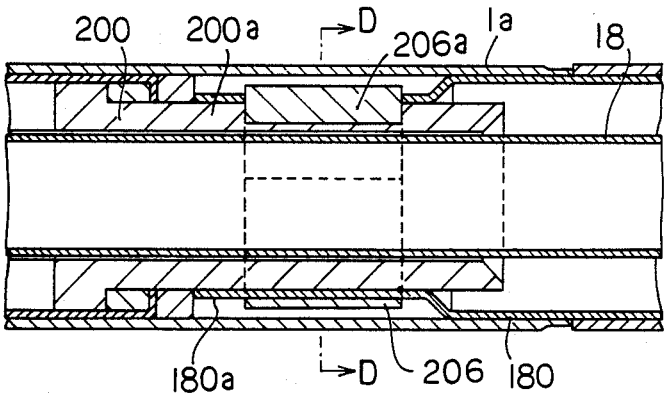
FIG. 29 is a sectional view showing the sixth connecting means.
Figure 31:
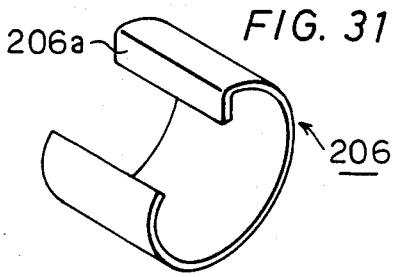
FIG. 31 is a perspective view showing the sixth connecting means.

FIGS. 29 and 31 illustrate the sixth connecting means, wherein a substantial $\frac{3}{4}$ of arcular stopping cylinder 206 is fitted outwardly from the fitting part 180*a* of the drive press fitted into the cam rod 200*a*. This stopping cylinder 206 has a bent part 206*a* bend inwardly, this bent part 206*a* is inserted into the insertion grooves 180*h* and 200*h* of the driver 180 and the cam rod 200*a*, respectively, a compressing force in a reduced diameter direction is applied to the fitted part 180*a* of the driver 180 so as to perform a rigid fitting described above.

Figure 32:
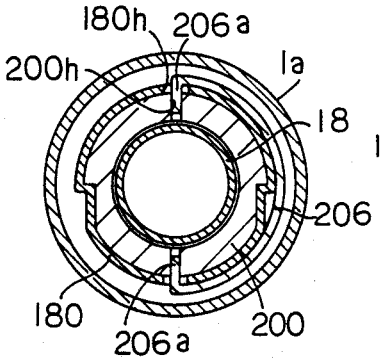
FIG. 32 is a lateral section for showing the seventh connecting means.
Figure 30:
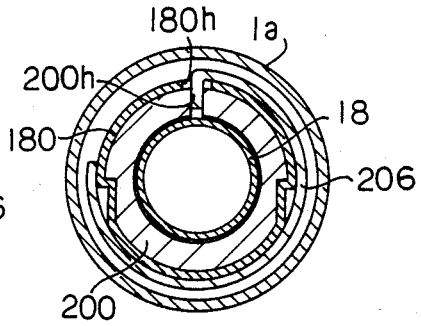
FIG. 30 is a sectional view taken along a line D—D of FIG. 29.

FIG. 32 shows the seventh connecting means, wherein the fitting part 180*a* of the driver 180 and the cam rod 200*a* are forcedly fitted to each other with the stopping cylinder 206. A point differing from the stopping cylinder for the sixth connecting means consists in that its shape is made as a substantial ½ arcular form and both ends are inserted into the insertion grooves 180*h* and 200*h* as the bent portions 206*a* and 206*a*.

In this preferred embodiment, as the lead pipe 18, a so-called cassette type to be removably fitted in the cassette adapter 110 is used, an opening or closing mechanism 70 is installed at the extremity end thereof and a removable rubber eraser part 27 is installed at the rear end thereof.

The opening or closing mechanism 70 has an end plug 28 removably arranged at the extremity end of the lead pipe 18 as shown in FIG. 9A and a resilient opening or closing part 29 fitted to the end plug 28. As shown in FIG. 9A, when the lead pipe 18 is inserted into the cassette adapter 110, a pipe 30 for releasing the resilient opening or closing part 29 is fitted into the cassette adapter 110.

In this case, the resilient opening or closing part 29 is made such that before insertion of the cassette adapter 110, the lead S can not be moved through the groove 29*a*, as shown in FIG. 33A to FIG. 33C and in turn in case of insertion, the groove 29*a* is widened as indicated in FIG. 9, resulting in that one lead can be moved through the groove.

Sizes of outer diameters of the mechanism adapter 100, upper housing 160 and driver 180 or the like are determined in such a manner as they may be dropped from their rear portions and assembled into the forward outer cylinder 1*a* and rearward outer cylinder 1*b*.

Then, an assemblying operation of the mechanical pencil will be described.

At first, after the cam bearing 201, cam 200 and cam follower 202 are inserted from the extremity end of the upper housing 160, the third resilient body 203 and a cassette adapter 110 of the pre-united lead feeding mechanism 7 are similarly inserted from the extremity end of the upper housing 160. Then, the fitted part 180*i* at the extremity end of the upper cylindrical housing 160 is press fitted and fixed to the mechanism adapter 100.

In turn, the cam 200 inserted into the upper housing 160 projects its cam rod 200*a* rearwardly. To this cam rod 200*a* is fitted and fixed the driver 180 with the above-mentioned means through the driver bearing 204. The driver 180 is press fitted and fixed the rearward outer cylinder l*b*.

In this way, the united lead feeding mechanism 7, rotary cam mechanism 90, lead pipe 18 and rearward outer cylinder 1*b* are dropped and inserted into at the rear part of the forward outer cylinder 1*a*. In this case, since the mechanism adapter 100 and the cassette adapter 110 or the like have a smaller diameter than that of the forward outer cylinder 1*a*, they may smoothly be inserted. After that, the tip element 3 is fitted to the extremity end 180*j* of the mechanism adapter 100 to complete the assembly operation.

The operation of the mechanical pencil will be described now.

The condition shown in FIG. 9 is a state where the slider 4 is locked and stored in the pencil. Therefore, the sliding element 202*a* of the cam follower 202 is positioned at the sliding element engaging part 190$a_2$ shown in FIG. 13.

As the rearward outer cylinder 1*b* is rotated from this condition in a direction indicated by an arrow R1 of FIG. 11, the rearward outer cylinder 1*b* and the cam 200 are integrally rotated, so that the sliding element 202*a* is relatively moved in a direction indicated by arrows L2, R2 on the cam surface 190 as shown in FIG. 13, passes from the released cam surface area Y to the point X and advances to the knock cam surface area Z.

Along with this movement, the lead feeding mechanism 7 also advances and the lead feeding is carried out during a process of advancing movement, the extremity end of the lead chuck 9 pushes and advances the slider 4 under a further substantial advancing movement later, and the lead guide pipe 4*a* advances to the position indicated by a dotted line in FIG. 9A. As the hand is removed from the rearward outer cylinder 1*b*, the rotary cam mechanism 90 is pushed rearwardly with the third resilient body 203, resulting in that the sliding element 202*a* is relatively returned back on the cam surface 190 and stopped at the position of point X. Then, in case that the lead S is worn out, the rearward outer cylinder 1*b* is slightly rotated in a direction of arrow L1 in FIG. 11A and the lead is fed. The slider 4 is positioned at a location where the lead guide 4*a* is projected out of the tip element 3, so that when under this condition if the lead guide pipe 4*a* is pushed against the paper sheet or the like, a part of the lead feeding mechanism 7 such as the lead guide pipe 4*a*, lead chuck 9 having the lead S fitted therein and sleeve 8 or the like is retracted inwardly and moved with the second resilient body 13 compressed by the pushing force.

Then, as the pushing force of the lead guide pipe 4*a* is released, the lead guide pipe 4*a* is stopped at the lead guide friction applying part 170. However, the lead S held by the lead feeding mechanism 7 is returned back to its original position together with the lead feeding mechanism 7 under a resilient force of the second resilient body 13, resulting in that the lead S is projected from the extremity end of the lead guide pipe 4*a* so writing can be carried out.

In this way, it becomes unnecessary to feed the lead under the knocking operation while the lead S is worn out by an amount corresponding to the area where the lead guide pipe 4*a* can move and so the writing can be continued subsequently without regripping the pencil.

Further, in order to return the slider 4 to the extremity end position of its movement, the rearward outer cylinder 1*b* is rotated to perform a knocking action, either the extremity end of the lead chuck 9 or the slider 4 is pushed or advanced and moved to the position of the moved extremity end.

Upon completion of a writing operation, the slider 4 is conveniently stored in the tip element 3 and the lead S and cloth are conveniently protected from being damaged. As the rearward outer cylinder 1*b* is rotated in a direction indicated by an arrow L1 shown in FIG. 11A, the sliding element 202*a* is relatively moved on the cam surface 190 from the point X to the released cam surface area Y, abutted against the releasing stopper surface 190$a_3$ and stopped there. At this position, the extremity end of the sliding element 202*a* is engaged with the sliding element engaging part 190$a_2$, so that even if the rearward outer cylinder 1*b* is removed, this is held at this position against the biasing force of the third resilient body 203 for use in return movement. Under this condition, the lead chuck 9 is kept at its released condition. Therefore, under this condition, if the extremity end of the lead guide 4*a* is pushed against the paper sheet or the like, the slider 4 is retracted and stored in the tip element 3 together with the lead S and returned back to the condition shown in FIG. 1.

As described above in detail, according to the rotary knock type mechanical pencil of the present invention, the pencil is comprised of a cam cylinder having a cam surface at its extremity end and integrally rotated with the rearward outer cylinder; and a lead feeding mechanism including a lead guide having at its rear end a cam engaging means in the cam surface of the cam cylinder, a lead chuck capable of holding and releasing the lead connected to the extremity end stored in the forward outer cylinder in such a way as it may be advanced or retracted under rotation of the cam cylinder, a tightening ring for fastening or releasing the extremity end of the chuck fixed to the lead guide, a sleeve arranged at an outer circumference of the chuck and for restricting the movement of the ring toward its rear end to be advanced or retracted together with the chuck, and a slider arranged in the tip element at the extremity end of the shaft, holding an outer circumference of the lead with a specified frictional force and sliding in the tip element. The present invention has the following various effects.

At first, no looseness of the inner mechanism or the like is generated and a positive lead feeding operation can be carried out when the lead feeding mechanism is advanced or retracted under a relative rotation of the forward outer cylinder and the rearward outer cylinder.

Secondly, the present invention is constructed such that the cam engaging means advanced or retracted slidably contacted with the cam cylinder and the chuck are integrally formed, the sleeve acting as the fastener for fastening of the chuck and its releasing action is separately made, and each of the springs is arranged between the sleeve and the inner circumferential surface of the fixed shaft and between the sleeve and the movable cam engaging means, so that even in case of performing of the rotary knock operation, a positive lead feeding operation can be performed under the action of these springs.

Thirdly, the arrangement of the component elements in the shaft and various mechanisms constituted by the component elements are made simple irrespective of much or less amount of component elements, thereby a superior workability in assembling operation of the inner mechanism can be attained and a manufacturing cost can be reduced to a less expensive value, trouble can be reduced while secular use is applied and further a maintenance cost can also be reduced.

Fourthly, each of the springs is arranged between the sleeve operating the chuck tightening member and the fixed shaft and between the sleeve and the movable shaft, thereby reaction added to the lead and the lead feeding mechanism from the paper sheet in case that the writer showing a strong writing pressure performs a writing can be dampened under a combination of the springs and further a breakage of lead can be prevented and the writer can get a superior writing touch during writing operation.

WHAT IS CLAIMED IS:

1. A mechanical pencil of the type having a lead feeding mechanism including a lead chuck fitted in a forward outer cylinder cooperatively operated to feed a lead responsive to rotation of a rearward outer cylinder rotatably and removably connected to the rear end of the forward outer cylinder a tip element at an end of the forward outer cylinder opposite the rearward outer cylinder slider means slidably mounted in the tip element for axial movement along the longitudinal axis thereof and a lead guide pipe in said slider means comprising:

cam engaging means connected at a rear end of the lead chuck of the lead feeding mechanism and movably inserted into the forward outer cylinder for axial movement together with the lead feeding mechanism, and a cam cylinder connected to the rearward outer cylinder, the cam cylinder being rotatably and removably inserted into the rearward part of the forward outer cylinder and having cam surface means at the front end thereof, the cam surface means including:

(a) a large cam surface, (b) a small cam surface, and (c) an engaging part arranged in front of said small cam surface the large cam surface being operatively engaged with said cam engaging means to axially slide said cam engaging means in a first direction responsive to a first substantially rotation of the rearward outer cylinder in a first rotary direction so that, sequentially, the chuck and lead guide pipe are moved forwardly through a chuck release position and the lead guide pipe is projected out of the tip element rotating the cam in the opposite direction past the large cam surface, the cam engaging means operatively engages said small cam surface, the small cam surface being for axially sliding said cam engaging means in said first direction response to rotation of the rearward outer cylinder in a second rotary direction opposite said first rotary direction so that said chuck is moved forwardly to a chuck release position, the engaging part being operative for locking said cam engaging means at a chuck releasing position; and wherein said lead guide pipe can be retracted and stored within the tip element at a chuck releasing position.

2. A mechanical pencil as set forth in claim 1 further comprising sleeve means removably inserted in the forward outer cylinder for holding the lead feeding mechanism and the cam cylinder the lead feeding mechanism being axially moveable within and extended from the forward end of said sleeve means.

3. A mechanical pencil as set forth in claim 2 wherein the lead feeding mechanism includes an axially extended rotation preventive projection and the sleeve means includes a rotation preventive groove in which the rotation preventive projection is slidably received for axial movement.

4. A mechanical pencil as set forth in claim 2 further comprising:

drive means for rotating the cam cylinder with the rearward outer cylinder;

the cam cylinder includes a cam rod with an outer circumferential surface, the cam rod being axially extended outwardly of the sleeve means within the outer forward cylinder;

the drive means including a cylindrical fitting part disposed about the cam rod and further comprising means for connecting the cylindrical fitting part to the cam rod wherein the connected means includes a stepped part, a rotation preventive groove formed on the outer circumferential surface of the cam rod and the cylindrical fitting part including an inner projecting piece engaged with the rotation preventive groove of the cam rod and an inner stop engaged with the stepped part of the cam rod.

5. A mechanical pencil as set forth in claim 2, including drive means for rotating the cam cylinder with the rearward outer cylinder, the cam cylinder including a cam rod with an outer circumferential surface, the cam rod being axially extended outwardly of the sleeve means within the outer forward cylinder, the drive means including a cylindrical fitting part disposed about the cam rod, and further comprising means for connecting the cylindrical fitting part to the cam rod, wherein the connecting means includes a projecting part formed on the outer circumferential surface of the cam rod, and the cylindrical fitting part including a groove, and the projecting part being fitted in the groove.

6. A mechanical pencil as set forth in claim 2, including drive means for rotating the cam cylinder with the rearward outer cylinder, the cam cylinder including a cam rod with an outer circumferential surface, the cam rod being axially extended outwardly of the sleeve means within the outer forward cylinder, the drive means including a cylindrical fitting part disposed about the cam rod, and further comprising means for connecting the cylindrical fitting part to the cam rod, wherein the connecting means includes a cam rod groove formed on the outer circumferential surface of the cam rod, the cylindrical fitting part having a fitting groove extending therethrough, the cam rod groove and the fitting groove being diametrically coincided, and a press engaging member inserted into the cam rod groove and fitting groove.

7. A mechanical pencil as set forth in claim 2, including drive means for rotating the cam cylinder with the rearward outer cylinder, the cam cylinder including a cam rod with an outer circumferential surface, the cam rod being axially extended outwardly of the sleeve means within the outer forward cylinder, the drive means including a cylindrical fitting part disposed about the cam rod, and further comprising means for connecting the cylindrical fitting part to the cam rod, wherein the connecting means includes a cam rod groove formed at the outer circumferential surface of the cam rod, the cylindrical fitting having a groove extending therethrough, the cam rod groove and the fitting groove being diametrically coincided, and an arcular stopping cylinder mounted at least partially around the fitting part and including a portion press fitted through the fitting groove and into the cam rod groove.

8. A mechanical pencil as set forth in claim 2 wherein the lead feeding mechanism includes a cassette adapter including a cassette receiving bore connected to the lead chuck, and further comprising a cassette for containing a plurality of the pencil leads removably extended through the cam cylinder and having an extremity end fitted in the cassette receiving bore.

* * * * *